US005586925A

United States Patent [19]

DiNorcia, Sr. et al.

[11] Patent Number: 5,586,925

[45] Date of Patent: Dec. 24, 1996

[54] APPARATUS AND METHOD FOR PROCESSING MARBLE

[75] Inventors: Anthony DiNorcia, Sr.; Anthony DiNorcia, Jr.; Donato L. DiNorcia, all of 702 7th Ave., Lake Worth, Fla. 33463

[73] Assignees: Donato DiNorcia; Anthony DiNorcia, Jr.; Anthony DiNorcia, Sr., all of Lake Worth, Fla.

[21] Appl. No.: 225,379

[22] Filed: Apr. 8, 1994

[51] Int. Cl.[6] ..... B24B 1/00

[52] U.S. Cl. ..... 451/35; 451/41; 451/328

[58] Field of Search ..... 451/32, 34, 35, 451/326, 328, 41

[56] References Cited

U.S. PATENT DOCUMENTS

| | | | |
|---|---|---|---|
| 828,591 | 8/1906 | Abbe | 451/328 |
| 1,516,913 | 11/1924 | Cramm | 451/328 |
| 1,590,655 | 6/1926 | Spicer | 451/328 |
| 1,946,440 | 2/1934 | Herrmann | 451/32 |
| 2,912,803 | 11/1959 | Simjian | 451/35 |
| 5,004,512 | 4/1991 | Fodera | 451/41 |

FOREIGN PATENT DOCUMENTS 730547 7/1977 U.S.S.R. .

*Primary Examiner*—Bruce M. Kisliuk
*Assistant Examiner*—Thomas W. Lynch
*Attorney, Agent, or Firm*—McHale & Slavin, P.A.

[57] ABSTRACT

An apparatus and method for artificially weathering large amounts of marble by use of a horizontally disposed drum having a stone lined interior surface. The drum houses a large quantity of marble having similar surface hardness together with a slurry of abrasive material including silica, clay, and gravel which operates to cushion the marble from chipping during tumbling of the marble. The stone lining of the drum absorbs the impact of marble to reduce or prevent chipping of the marble. The marble and slurry are rotated at a particular speed for a predetermined amount of time. Various types of acid can also be inserted into the mixture providing a faster processing time and surface etching not possible with straight abrasion techniques. The processed marble is removed from the drum and sliced in half so to provide two pieces of weathered tile each having a flat mounting surface.

11 Claims, 2 Drawing Sheets

APPARATUS AND METHOD FOR PROCESSING MARBLE

FIELD OF THE INVENTION

This invention pertains in general to floor coverings and in particular to an apparatus and method for texturing marble.

DESCRIPTION OF THE PRIOR ART

Crystalline metamorphosed calcium carbonate, commonly known as marble, is a form of limestone capable of taking a high polish. Having been mined for centuries, marble is valued for its beauty and adaptability for various construction uses. Pentelic marble is mined from the quarries of Mount Pentelikon in Attica and used by sculptors of ancient Greece such as Phidias. Elgin marble is mined from the quarries of Mount Papessa and also used by sculptors and architects of ancient Greece. Carraba marble, mined in the Apuan Alps of Italy and quarried in the region around Carrara, Massa, and Serrvezza, was used in Italy from the time of the first emperor Augustus and forms the basis of some of the greatest works of Michelangelo.

Impurities together with the level of crystallation produce classifiable levels of hardness. The impurities create variegated patterns of colors which are prized for their attractiveness. The hardness of the marble provides for various construction uses. For instance, Verde Mente is one of the softest forms of marble which is excellent for sculpting but not for conventional floor coverings. Carrara is harder marble, Portoro is harder than Carrara, and Green Dark is one of the hardest marbles. Thus, the exposed surface of marble reacts differently when exposed to the elements. While all marble is considered durable in a dry atmosphere, some kinds of marble readily crumble when exposed to a moist acid atmosphere. The actual rate of decay is dependent upon the marble hardness and the environment exposure of the marble. Marble that is "weathered" due to exposure is appealing for numerous applications providing a surface that appears to date back to the time of Michelangelo. The problem in providing a weathered marble surface, to which this invention is directed, is that marble is not exposed to natural weathering process while in the earth.

It is apparent that mined marble could be artificially weathered by spraying acidic water over the surface but such a process is impractical since regulations typically prevent the dispersion of low pH fluids on the ground. Sand blasting of marble could also provide a weathered surface but is an expensive proposition for treating large amounts of marble. U.S. Pat. No. 5,140,783 discloses a method of surface finishing materials using a large vibrating container filled with material having an abrasive coating, a process that is impractical for the instant application as marble is easily cracked or chipped by impacting other hard objects.

Thus, what is needed in the art is an apparatus and method for treating large amounts of marble without chipping or cracking so as to provide the sought after uniformly weathered surface that has developed great appeal for the average consumer.

SUMMARY OF THE INVENTION

The instant invention comprises an apparatus and method for artificially weathering large amounts of marble by use of a horizontally disposed drum having a stone lined interior surface. Within the drum is placed a large quantity of marble having similar surface hardness together with a slurry of abrasive material which operates to cushion the marble from chipping. The stone lining of the drum can be soapstone, limestone, porcelain, ceramic, or the like providing an irregular surface that provides a tumbling effect yet absorbs the impacting of marble. The materials are rotated at a particular speed for a predetermined amount of time. Various types of acid can also be inserted into the mixture providing a faster processing time and surface etching not possible with straight abrasion techniques. Once the marble is processed it is removed from the drum and sliced in half so as to provide two pieces of weathered tile, each having a flat mounting surface and the sought after weathered surface.

The drum includes a sealable hatch on the side of the drum for insertion of the marble and a slurry mixture of silica sand, pea gravel, clay and water. On a 3000 liter drum, the processing of soft marble requires the mixture to be rotated at approximately 16 revolutions per minute for approximately 2800 revolutions. If the marble is hard, the drum is rotated approximately 5900 revolutions at approximately 32 revolutions per minute. Use of hydrochloric, oxalic, or the like acid will reduce the amount of revolutions as well as provide the unique surface etching mentioned previously.

Accordingly, a primary objective of the instant invention is to teach a method of processing large quantities of marble to provide a uniformly weathered appearance without damaging the marble.

Still another objective is to disclose an apparatus capable of tumbling large quantities of marble utilizing a lining constructed of materials that prevent marble sliding and chipping.

Yet still another objective of the invention is to teach a method of artificially weathering marble that is environmentally safe utilizing reusable abrasive materials. The above-stated objectives as well as other objectives which, although not specifically stated, but are intended to be included within the scope of the present invention, are accomplished by the present invention and will become apparent from the hereinafter set forth Detailed Description of the Invention, Drawings, and the claims appended herewith.

DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
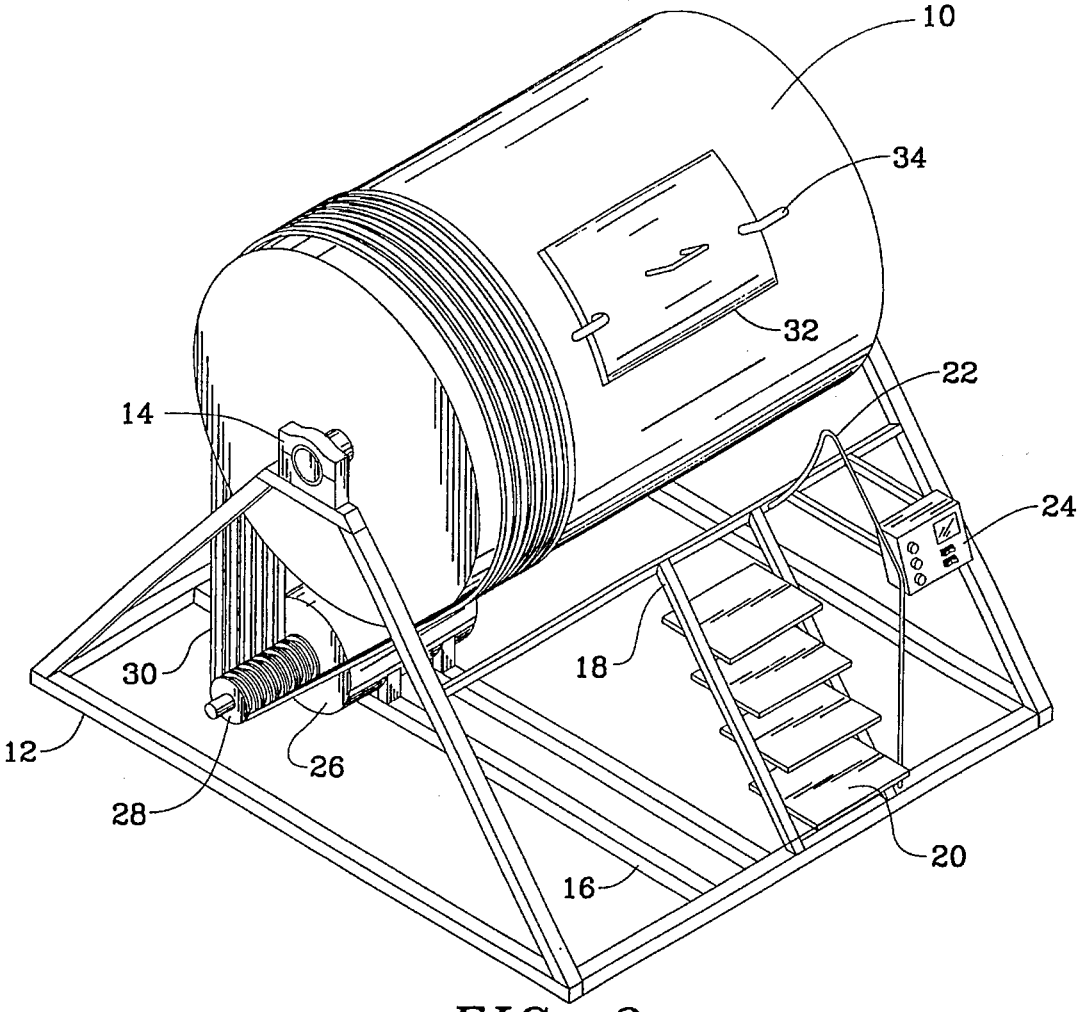
FIG. 1 is a pictorial view of the apparatus of the instant invention used for tumbling marble tile.

Turning now to the drawings in detail and initially to FIG. 1 thereof, the apparatus of the instant invention is disclosed wherein drum 10 is defined as a steel tubular housing having a continuous side wall and two end walls. The drum is supported by a structure steel support member 12 having a bearing housing 14 to support bearing trusses, not shown, which extend outwardly from each end wall of the drum 10. Member 12 includes a centrally disposed motor support member 16 slightly offset from the centerline of the member 12 so that fluid spillage will not drop on to the drive belt pulley shaft. The actual size of the drum is dependant on the quantity of marble to be processed. The preferred embodiment is to use a 500, 2,000, or 3,000 liter drum.

A ladder frame 18 provides support for steps 20 providing operator access to materials placed within the drum 10. Ladder railing 22 is available for the operator and provides support for control panel 24 which controls the electric motor 26 drive means. The control panel typically includes an on/off switch, circuit breaker, hour meter, rotation counter, rpm monitor, and timer mechanism to automatically shut down the motor after the drum has rotated a preset number of revolutions. The drive motor 26 utilizes drive shaft 28 for engaging a plurality of drive belts 30 necessary to frictionally engage the outer surface of drum 10 for purposes of rotation without slippage in conjunction with the rotation of the drive shaft 28.

A removable access door 32 is locked in position by engagement tabs 34 and sized so as to provide sufficient room for operator access into the interior of the drum 10. The access door 32 can be lined with similar stone like material as the remainder of the drum or preferable with rubber making the door lightweight. A door 32 lined with rubber is also more resilient to the frequent openings and subsequent droppage providing superior fluid sealing capability during operation.

Figure 2:
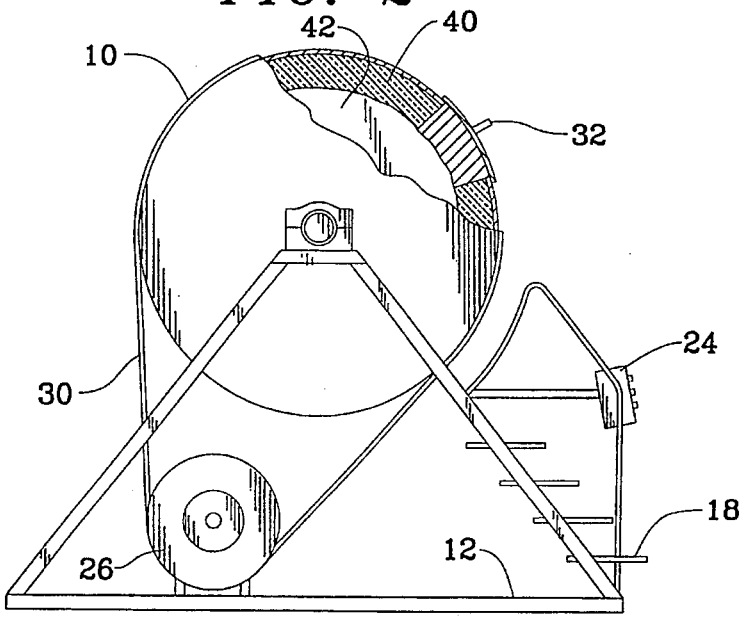
FIG. 2 is a partial cross sectional side view of FIG. 1.

FIG. 2 depicts a pictorial side view of FIG. 1 wherein the end wall of drum 10 is removed illustrating the lined surface 40 which is formed of stone like element, such as soapstone, limestone, porcelain, ceramic, or the like element. Alternative linings can be used such that the lining is capable of chipping before the marble chips so that the lining is available to accept the impact of the marble. The lining further provides resistance to acidic fluids that may be used within the drum for etching of marble. An internal cavity 42 formed within the drum is available for placement of the marble as well as the abrasive slurry. Access to the drum is depicted in the drawing wherein the door 32 is tilted to a position above the slurry level so as to prevent spillage when access is needed.

Figure 3:
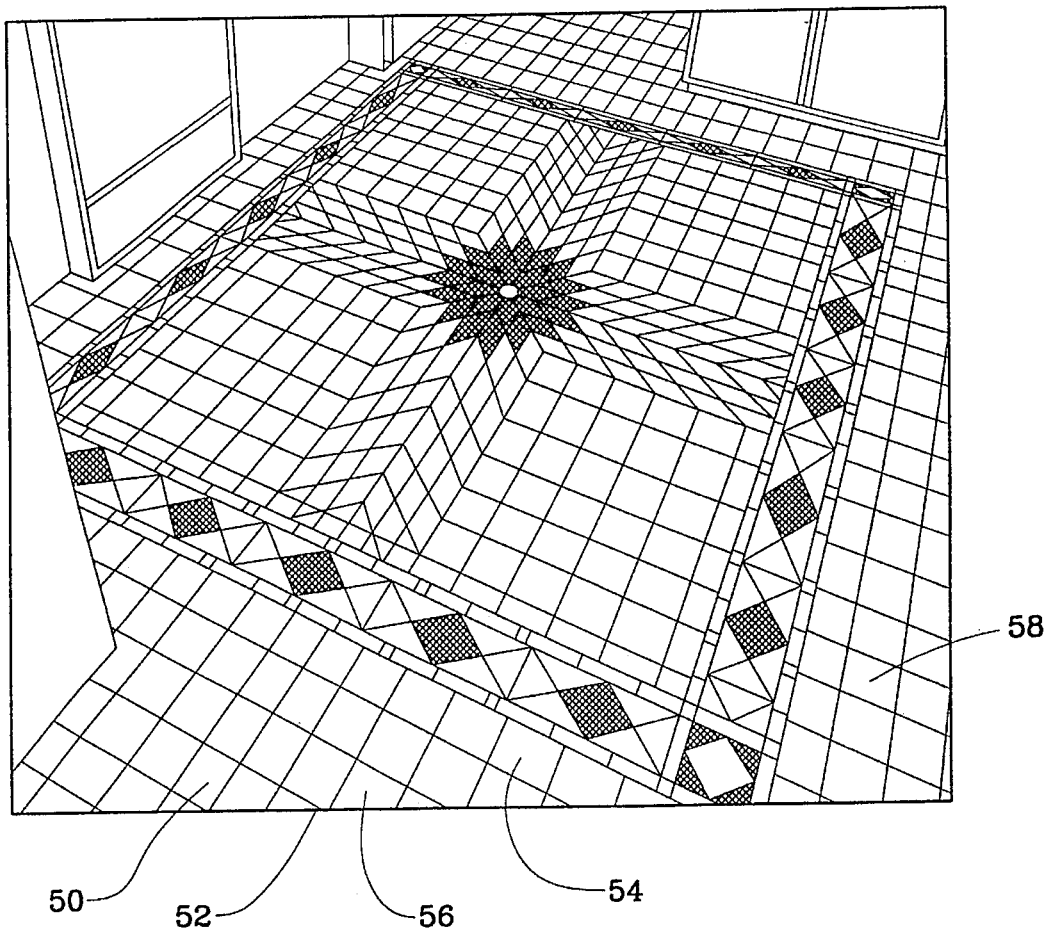
FIG. 3 is a pictorial view of a patterned layout of weathered tile.

FIG. 3 sets forth an illustration of the treated material wherein the processed tile 50 is placed in a kitchen setting depicting the weathered aspects of the tile highlighted by the grouting 52. The tile surface 54 shows the textured appearance that provides a uniqueness that cannot be duplicated, for each tile has individual character. The tile can be cut into irregular shapes before processing as evidenced by the diamond shape tile 56, and made part of the unique pattern 58 that can be copied but not duplicated.

Figure 4:
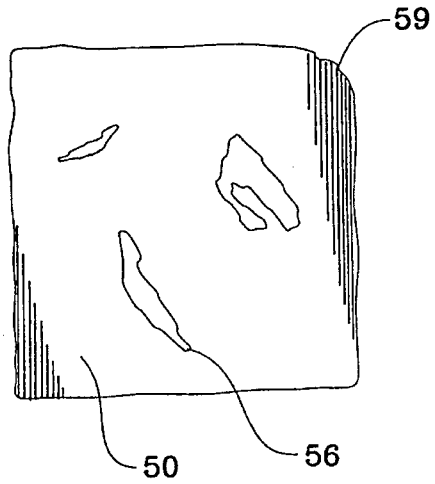
FIG. 4 is pictorial view of a piece of processed marble.

FIG. 4 sets forth a top view of a piece of tile 50 illustrating the irregular shaped sides 52 produced during the tumbling process. Surface etching 56 can be enhanced by optional use of acidic substance to obtain a greater depth of material removal.

Figure 5:
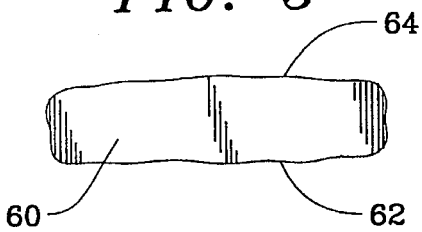
FIG. 5 is a side view of FIG. 4.
Figure 6:
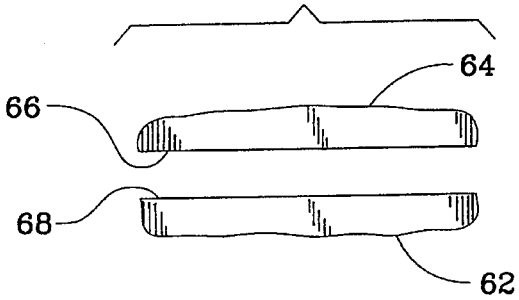
FIG. 6 is FIG. 5 after the marble is sliced.

FIG. 5 is an end view of a typical piece of tile which may have a side wall 60 of one inch in thickness wherein the tumbling process affects both the bottom surface 62 as well as the upper surface 64. FIG. 6 depicts a tile sliced down the longitudinal center of a piece of marble tile upon fabrication, thereby providing two separate pieces with the first piece of tile having a treated surface 62 and a flat mounting surface 68. Additionally the second piece of tile also has a treated surface 64 and a smooth mounting surface 66.

The process of surface treating marble to produce a weathered appearance consists of the steps of first selecting a group of marble materials having similar hardness. A majority of the most popular marble materials can be classified into four classifications of hardness. Chart 1 identifies popular types of marble by their recognized name with Group I identifying the softest type of marble and Group IV identifying the hardest marbles.

CHART 1

| Group I | Group II | Group III | Group IV |
|---|---|---|---|
| LIME-STONE VERDE MENTE | CARRARA TRAVERTINO CLASSICO TRAVERTINO LIGHT BARDIGLIO TRAVERTINO PINK TRAVERTINO SILVER THASSOS | BIANCO PERLINO BOTTICINO ROSA PERLINO ROSSO VERONA BLANCO AURORA EMPERADOR DARK NERO MARQUINA ROJO ALICANTE ROSA AURORA ROSA GIRONA ROSSO LEVANTO TRAVERTINO CHOCOLATE CREMA VALENCIA NORWEGIAN ROSE PORTORO ROSSO LAGUNA | GREEN DARK GREEN LIGHT |

An operator deposits marble into the horizontally disposed drum 10 by removal of the access hatch 32. The interior surface of the drum has a stone like lining that will sacrifice itself before the marble will chip thus accepting marble impacts without damaging the marble. During insertion of the marble, silica sand is placed into the drum to operate as the abrasion material. In the preferred embodiment three grades of silica: 6-20, 8-20, and 20-30 are added to the drum, as well as pea rock which prevents coagulating and provides the marble with a rolling action. Water is added into the drum, together with a contingency of clay. The clay further acts to prevent the marble from quick movement and is maintained in a fluid state by use of the pea gravel. The marble and slurry mixture is then rotated for a predetermined period of time, depending upon the hardness of the marble materials.

EXAMPLE 1

A 500 liter machine is used to process approximately 1,700 pounds of TRAVERTINO SILVER in sizes from ½"×½" up to 6"×6" tile pieces. The marble is placed within the 500 liter drum together with 60 to 70 gallons of water, 140 to 160 pounds of silica sand having mesh sizes of 6-20, 8-20, and 20-30. In addition, 25 to 35 pounds of clay is added. The drum is then rotated at 33 revolutions per minute for approximately 10,500 revolutions. Optionally, one pound of oxalic acid or two pounds of hydrochloric acid can be added to the slurry mixture providing an acidic substance that provides unique surface etching and can lessen the processing time. After processing the marble materials are removed from the drum and sliced along a longitudinal length thereof to provide two separate marble pieces. The sliced area provides a flat surface for mounting to a floor.

The control panel 24 of the apparatus can employ a revolution counter and automatically stop the rotation when a present number is reached. Group I materials are rotated between 6,000 and 6,500 revolutions; Group II materials are rotated between 10,000 and 10,500 revolutions; Group III materials are rotated between 12,000 and 12,500 revolutions; and, Group IV materials are rotated between 16,000 and 16,500 revolutions.

EXAMPLE 2

A 2,000 liter machine is used to process approximately 6,800 pounds of ROSSO LEVANTO in sizes between 1"×1" to 18"×18". The marble materials are placed within the machine together with approximately to 250 to 300 gallons of water and 560 to 600 pounds of silica having a mesh size between 6-20, 8-20, 20-30, together with 100 to 125 pounds of clay. In this example, the optional chemical to be added could be four pounds of oxalic acid or eight pounds of hydrochloric acid. The 2,000 liter machine is rotated at 16 revolutions per minute approximately 4,800 revolutions.

Using a 2,000 liter machine, Group I materials are rotated between 3,000 and 3,400 revolutions; Group II materials are rotated between 4,500 to 4,800 revolutions; Group III materials are rotated between 5,700 to 5,900 revolutions; and, Group IV materials is rotated between 6,500 and 6,800 revolutions.

EXAMPLE 3

A 3,000 liter machine is used to process those material sizes from one half inch by one half inch to 18 inches by 18 inches. In a 3,000 liter machine 9,600 to 10,000 pounds of material is added into the drum together with 360 to 400 gallons of water and 760 to 780 pounds of calico having a mesh size between 6-20, 8-20, 20-30. Also to the slurry is added between 150 to 160 pounds of clay. Optional chemical to be added would be five pounds of oxalic acid or ten pounds of hydrochloric acid. The 3,000 liter machine is rotated at 16 revolutions per minute with group one materials rotated between 2,800 and 3,000 revolutions, group two materials rotated between 3,800 and 4,000 revolutions, group three materials rotated between 4,700 and 4,900 revolutions, and group four materials rotated between 5,800 to 5,950 revolutions.

While the invention has been described, disclosed, illustrated, and shown in certain terms or certain embodiments or modifications which it has assumed in practice, the scope of the invention is not intended to be, nor should it be, deemed to be limited thereby, and such other modifications or embodiments as may be suggested by the teachings herein are particularly reserved especially as they fall within the scope of the breadth and scope of the claims here appended.

What we claim is:

1. A method for surface treating marble to produce a weathered appearance comprising the steps of:

(a) selecting a group of marble materials having similar hardness;

(b) depositing said marble materials in a drum having an interior stone lined surface;

(c) placing silica sand into said drum;

(d) adding water into said drum;

(e) adding clay to said drum;

(f) rotating said drum for a predetermined period of time dependant upon the hardness of said marble materials;

(g) removing said marble materials from said drum; and (h) slicing said marble materials along a longitudinal length thereof to provide two separate marble pieces with weathered veneer surfaces and flat mounting surfaces.

2. The method of surface treating marble according to claim 1 wherein said stone lined surface is selected from the group of limestone, soapstone, porcelain or ceramic.

3. The method of surface treating marble according to claim 1 including the step of making said water acidic.

4. The method of surface treating marble according to claim 1 wherein step (c) includes a plurality of silica sand grades.

5. The method of surface treating marble according to claim 1 wherein step (c) includes the addition of pea gravel.

6. A method for surface treating marble to produce a weathered appearance comprising the steps of:

(a) selecting a group of marble materials having similar hardness;

(b) depositing said marble materials in a horizontally disposed drum having an interior surface lined with a material from the group of limestone, soapstone, porcelain or ceramic;

(c) placing three distinct meshes of silica into said drum;

(d) placing pea gravel into said drum (e) adding water into said drum;

(f) adding clay to said drum;

(g) rotating said drum at about 16 revolutions per minute for a predetermined period of time dependant upon the hardness of said marble materials;

(h) removing said marble materials from said drum; and (i) slicing said marble materials along a longitudinal length thereof to provide two separate marble pieces with weathered veneer surfaces and flat mounting surfaces.

7. The method of surface treating marble according to claim 6 including the step of making said water acidic.

8. The method of surface treating marble according to claim 6 wherein the revolutions per minute in step (g) is doubled.

9. An apparatus for tumbling a large quantity of marble to provide a weathered appearance to the marble without chipping of the marble, said apparatus comprising: a drum formed from a tubular housing means having two end walls and a continuous side wall, said walls forming a shell to support an inner surface having a solid lining of a material from the group of limestone, soapstone, porcelain or ceramic used in combination with a slurry formed from a combination of silica sand, pea gravel and moistened clay, said inner surface defining an interior chamber with at least one inlet means disposed along said side wall; said end walls each having a centrally disposed bearing truss; each said bearing truss having a structural steel support member having a bearing housing operatively associated with each said bearing truss; a drive means for rotation of said drum about said centrally disposed bearing truss.

10. The marble tumbling apparatus recited in claim 9, wherein said drive means rotates said drum at approximately 16 revolutions per minute.

11. The marble tumbling apparatus recited in claim 9, wherein said drive means rotates said drum at approximately 33 revolutions per minute.

* * * * *